US008136603B2

(12) United States Patent
Schneider

(10) Patent No.: US 8,136,603 B2
(45) Date of Patent: Mar. 20, 2012

(54) METHOD OF PREVENTING DROPPED CASING STRING WITH AXIAL LOAD SENSOR

(75) Inventor: Warren P. Schneider, The Woodlands, TX (US)

(73) Assignee: Tesco Corporation, Houston, TX (US)

( * ) Notice: Subject to any disclaimer, the term of this patent is extended or adjusted under 35 U.S.C. 154(b) by 226 days.

(21) Appl. No.: 12/552,156

(22) Filed: Sep. 1, 2009

(65) Prior Publication Data

US 2011/0048737 A1 Mar. 3, 2011

(51) Int. Cl.
*E21B 19/16* (2006.01)

(52) U.S. Cl. ..... 166/380; 166/77.52; 166/77.53; 166/85.1

(58) Field of Classification Search ..... 166/380, 166/77.52, 77.53, 85.1
See application file for complete search history.

(56) References Cited

U.S. PATENT DOCUMENTS

| | | | | |
|---|---|---|---|---|
| 5,347,859 | A | 9/1994 | Henneuse et al. | |
| 6,527,493 | B1 | 3/2003 | Kamphorst et al. | |
| 6,688,398 | B2 | 2/2004 | Pietras | |
| 6,742,596 | B2 * | 6/2004 | Haugen | 166/380 |
| 7,090,021 | B2 | 8/2006 | Pietras | |
| 7,281,587 | B2 | 10/2007 | Haugen | |
| 2002/0170720 | A1 | 11/2002 | Haugen | |
| 2004/0069500 | A1 * | 4/2004 | Haugen | 166/380 |
| 2006/0124353 | A1 | 6/2006 | Juhasz et al. | |
| 2007/0131416 | A1 | 6/2007 | Odell et al. | |
| 2008/0149326 | A1 | 6/2008 | Angelle et al. | |
| 2008/0202810 | A1 | 8/2008 | Gomez | |
| 2008/0264648 | A1 | 10/2008 | Pietras et al. | |

FOREIGN PATENT DOCUMENTS

| | | |
|---|---|---|
| NO | 2008 81650 | 4/2008 |
| WO | WO96/18799 | 6/1996 |

OTHER PUBLICATIONS

International Search Report and Written Opinion dated Apr. 18, 2011.
NOBLE Downhole Technology, Ltd. Instrumented Surface Sub DOE Project (DE-FC26-03NT41782), pp. 1-12, www.noblecorp.com.

* cited by examiner

*Primary Examiner* — Nicole Coy
(74) *Attorney, Agent, or Firm* — Bracewell & Giuliani LLP

(57) ABSTRACT

A method of running casing into a well utilizes a load sensor to avoid dropping the casing string accidentally. The rig has a spider at the rig floor that suspends a casing string in the well when in a gripping position. A casing lifting mechanism will place a new joint of casing on the casing string suspended in the spider. The new joint of casing is rotated to make up with the casing string. After makeup, the casing lifting mechanism lifts the new joint of casing and the casing string. The operator releases the spider to allow the casing string to be lowered further into the well. Before releasing the spider, a load sensor will send a signal indicating that the casing lifting mechanism is supporting a minimum amount of weight.

11 Claims, 3 Drawing Sheets

METHOD OF PREVENTING DROPPED CASING STRING WITH AXIAL LOAD SENSOR

FIELD OF THE INVENTION

This invention relates in general to running casing into a well bore, and in particular a method of avoiding dropping the casing while it is being run.

BACKGROUND OF THE INVENTION

Most oil and gas wells are drilled by a drill string made up of drill pipe. At various depths and at the total depth, the operator will remove the drill pipe, then run in a string of casing. The casing lines the well bore and is cemented in place. In another technique, casing is employed as the drill string and when reaching a desired depth, it is cemented in place.

When running casing into a well either for casing the well or for casing drilling the well, normally a powered spider is employed at the drill rig floor. The powered spider is a device that encircles the hole in the rig floor. It has segments or slips that will slide down to a gripping position gripping the casing string suspended in the well bore. Fluid power, typically hydraulic, is employed to move the slips back to an upper position to allow the casing to be lowered into the well bore.

The spider will support the casing string while a new joint of casing is being made up to it. The new joint of casing will be hoisted by a casing lifting mechanism above the casing string suspended in the well. In one technique, the casing lifting mechanism comprises a casing gripper mounted to a top drive. The top drive runs up and down the derrick and also is capable of rotating a drill string or casing string. The casing gripper has gripping members that can be moved to a gripping position wherein they will engage a wall of the casing to support the casing. The grippers may engage either the inner diameter or the outer diameter of the casing. Typically the casing gripper is actionable by fluid power, such as hydraulic fluid, to move the grippers to their released position.

In another technique, rather than a casing gripper mounted to a top drive, the operator will employ a casing elevator, which is suspended by the blocks or a top drive in the derrick. The casing elevator is capable of gripping a string of casing and supporting the weight. The casing elevator is typically moved from the gripping position to the released position by fluid power.

After the operator makes up the new joint of casing with the casing string suspended by the spider, he will lift the entire casing string slightly, then release the spider to lower the casing string further into the well. When the upper end of the uppermost joint of the casing string nears the spider, the operator again engages the spider to support the casing string. The operator releases the casing lifting mechanism and repeats the process.

There are thus at least two valves that are controlled by personnel on the rig floor, one being to release the spider and the other being to release the casing gripping mechanism. If an operator accidentally moves the spider valve while the casing lifting mechanism is open, it is possible that the casing string could fall into the well bore. Normally the fluid release mechanism for the casing lifting mechanism is not sufficiently strong to release the casing lifting mechanism unless the weight of a joint of casing has been removed from it. However, many spiders have release mechanisms that will release a casing string while supporting it if the casing string weight is not very much. For example, that might occur when only a few joints of casing make up the casing string. It might also occur with a long casing string when this string is being run into a highly deviated well such as a horizontal well. It could also occur with under balanced drilling. There are some proposed solutions but improvements are desired.

SUMMARY OF THE INVENTION

In this invention, the spider is not released until a controller is assured that the casing lifting mechanism is supporting a minimum amount of weight. In one embodiment, that is performed by providing an axial load sensor for the casing gripper. The load sensor may be a sub mounted above the casing gripper. Preferably the casing gripper sensor will send a signal to the controller indicative of the amount of weight that it is sensing. If the weight is greater than a selected minimum amount, the controller will allow the spider to be released. If not, the controller prevents the spider from being released. If the casing gripper sensor is mounted to a sub above the casing gripper, the weight sensed by it has to be greater than the weight of the casing gripper plus a minimum amount before the controller will release the spider.

In another embodiment, the operator provides the spider with a load sensor. The load sensor determines the weight being supported by the spider. If the load sensor indicates that the spider is supporting more than a minimum amount of weight, the controller will not allow the manual control to release the spider. One manner of determining this weight is to place the spider on a weight measuring scale or sensor which senses the weight imposed on it. If the weight sensed by the spider sensor is greater than the weight of the spider, the controller will not allow the spider to release. For redundancy, both the casing gripper sensor and the spider sensor may be employed.

DETAILED DESCRIPTION OF THE INVENTION

Figure 1:
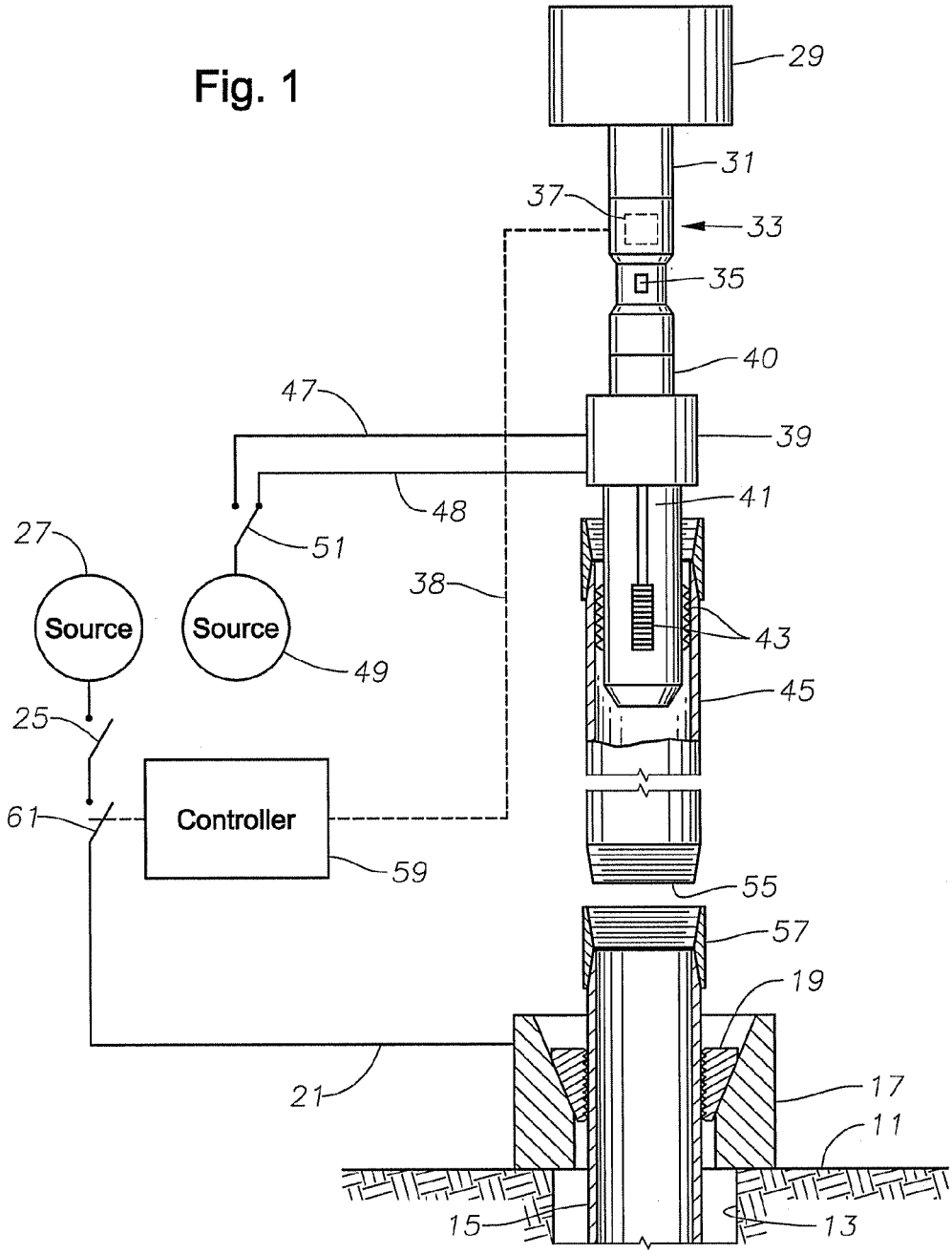
FIG. 1 is a schematic view illustrating the safety method of this invention being employed by sensing weight on a casing gripper.

Referring to FIG. 1, a drilling rig has a rig floor 11 with an opening 13 aligned with a well (not shown). Opening 13 may be a rotary table. A casing string 15 is shown extending into the well through opening 13. Casing string 15 is made up of pipe intended to line the well bore and be cemented in place. Casing string 15 also may be employed to perform drilling of the well bore before it is cemented in place. Alternately, the well bore may have already been drilled by drill pipe and casing string 15 is being run into the well bore. Although the term "casing string" is employed, the pipe could either be what is conventionally referred to as casing or what is conventionally referred to as liner. The pipe for both casing and liner may be the same; however casing extends all from the bottom of the well bore all the way to the well head at the top of the well. A liner is also cemented in place but it typically extends only to a short distance above the lower end of a preceding string of casing installed in the well. The term "casing string" is thus meant to include both casing and liner strings.

A spider 17 at rig floor 11 supports the weight of casing string 15. Casing string 15 may comprise only one or two joints of casing or it may comprise several hundred joints of casing. Spider 17 has segments or slips 19 that slide down a ramp surface to grip and support the weight of casing string 15. Slips 19 may be moved back up to a released position by imposing fluid pressure to a piston incorporated within spider 17. The fluid pressure may be pneumatic or hydraulic and comes from a fluid line 21. The operator is able to move slips 19 back up to the released position by closing a valve 25 that is connected into fluid line 21 between a fluid pressure source 27 and spider 17. Although spider 17 is shown extending above rig floor 11, it could alternately be located recessed so that its upper end is substantially flush with rig floor 11.

The drilling rig includes a top drive 29 in this example. Top drive 29 is a conventional member that may be raised and lowered in the derrick by a hook (not shown). Top drive 29 has a quill 31 that it rotates. In this embodiment, a sensing sub 33 is mounted to quill 31. Sensing sub 33 has at least one sensor 35 that will sense the axial load passing through sensing sub 33. For example, sensor 35 may be a strain gauge. Sensor 35 is connected to a transmitter 37 mounted to sensing sub 33. Transmitter 37 is battery powered and will send a radio frequency signal 38 indicative of the weight being sensed by sensing sub 33. Sensing sub 33 may have other sensors, as well, such as one to measure torque.

A casing lifting mechanism comprising a casing gripper 39 has a rotary mandrel 40 that secures to the lower end of sensing sub 33. Casing gripper 39 may be of various types and in this example, it includes a spear 41 that extends downward from and is rotated by mandrel 40. Grippers 43 are mounted on spear 41. Casing gripper 39 has an internal mechanism for sliding grippers 43 along a ramp surface to move radially outward and grip the inner diameter of a casing joint 45. Alternately, grippers 43 may be positioned on the outer side of casing joint 45 for moving radially inward to grip the exterior of casing joint 45. Casing gripper 39 normally has a spring and a piston (not shown). The spring urges grippers 43 toward the gripping position. Fluid pressure applied to the piston urges grippers 43 back to the released position. Mandrel 40 and spear 41 are rotatable in unison with each other while the actuator portion of casing gripper 39 remains stationary. Typically, an anti-rotation member (not shown) extends downward from the stationary part of top drive 29 into engagement with the stationary portion of casing gripper 39 to prevent its rotation.

The fluid pressure to release casing gripper 39 may be either pneumatic or hydraulic. In this example, the fluid pressure is supplied by a fluid line 47 from a fluid source 49. Fluid source 49 may be the same as source 27. A casing gripper valve 51 is operated by personnel on the rig floor to supply fluid pressure to cause casing gripper 39 to move to the released position.

It is important that an operator not cause spider 17 to release casing string 15 unless casing string 15 is being supported by casing gripper 39. Normally, the weight of a single casing joint 45 is sufficient to prevent casing gripper 39 from being released even if casing gripper valve 51 is closed. However, if the weight of casing string 13 is not very heavy, it is possible that the fluid pressure in line 21 and the piston mechanism of spider 17 are sufficient to release casing string 15 from spider 17 if spider valve 25 is closed. A controller 59 is employed to prevent this occurrence.

Controller 59 has a receiver to receive signal 38 from casing gripper sub 33. Controller 59 has circuitry that will determine whether that signal indicates a minimum weight is being supported by casing gripper 39. Preferably, the minimum weight is equal to the weight of casing gripper 39 plus the approximate weight of an average casing joint 45. In the position shown in FIG. 1, sensor 33 would be sensing the weight of casing gripper 39 and casing joint 45 but no more. Consequently, controller 59 would not send a signal to a safety valve 61. Safety valve 61 is normally open and is connected into line 21 between source 27 and spider 17. If the weight sensed by sensor 33 is greater than the weight of casing gripper 39 and casing joint 45, the signal may be sent by controller 59 to safety valve 61, either by electrical wire or wireless. In order for fluid power to be supplied to spider 17 over line 21, safety valve 61 must be closed, and it will not close until it receives a signal from controller 59 indicating that the weight observed by sensor 33 is above the minimum selected weight. If the operator closes valve 25 when the weight is not above the minimum, controller 59 will not close safety valve 61. Instead, it preferably sounds a warning that may be audible and/or visible.

Controller 59 may have circuitry and a panel that allow the operator to zero out the weight of casing gripper 39 and one joint of casing 45 when casing gripper 39 is first installed. In that event, sensor sub 33 would provide a signal 38 of zero weight if casing gripper 39 is supporting only casing joint 45 before it is connected to casing string 15. Alternately, sensor sub 33 would provide no signal at all until the weight exceeds the weight of casing gripper 39 and casing joint 45. The operator could also set a minimum value that is somewhat above that level. However, the value selected above the weight of casing gripper 39 and casing joint 45 would normally not be very high and is preferably less than the weight of one more joint of casing. During the initial stages of casing running, casing string 15 may comprise only a single joint, and if casing joint 45 is properly connected on its lower end to the single joint of casing string 15 and on its upper end to casing gripper 39, the operator should be free to release spider 17 to lower casing joint 45 and casing string 15. The release signal from controller 59 to safety valve 61 should be sent even though the weight sensed by sensor 35 is only the weight of two joints of casing plus the weight of casing gripper 39.

In the operation of the embodiment of FIG. 1, the operator will have assembled one or more joints of casing to make up casing string 15 and will have it supported by spider 17. For example, if there is only one joint of casing in casing string 15, the operator will simply lower it then actuate spider 17 to grip casing string 15. A bypass may be provided to allow an operator to bypass safety valve 61 to enable the first joint of casing in casing string 15 to be lowered into spider 17. The operator then picks up a new joint of casing, represented by casing joint 45. Normally the operator will pick it up with a set of elevators (not shown) attached to links, which in turn are attached to casing gripper 39. In one technique, the operator then rests new casing joint 45 on casing string 15 and lowers spear 41 while casing gripper valve 51 is closed, which places the grippers 43 in a released position. Once spear 41 is inserted, the operator opens casing gripper valve 51 to cause grippers 43 to grip casing joint 45. The operator then raises top drive 29 a short distance to assure that grippers 43 are gripping casing 45. FIG. 1 shows this position, with lower end 55 of new casing joint 45 a short distance above casing collar 57, which is at the upper end of casing string 15.

The operator then lowers lower end 55 into engagement with the threads of casing collar 57. The operator rotates top drive quill 31, sensing sub 33 and spear 41, causing new casing joint 45 to rotate. With spider 17 or another mechanism, the operator prevents rotation of casing string 15 until the threads have properly made up. The operator then raises top drive 29 a short distance to remove the weight being supported by spider slips 19. Sensing sub 33 at that point will be sensing the weight of casing gripper 39, new casing joint 45 and casing string 15. Since this weight is over the selected minimum, controller 59 will close safety valve 61. The operator then closes spider valve 25 to open spider slips 19. The closure of safety valve 61 and spider valve 25 allows fluid pressure from source 27 to move slips 19 upward and away from casing string 15. When in the upper position, adequate clearance will be provided for casing collar 57 to pass downward through spider 17. If the weight sensed by sensor 35 is not over the minimum when the operator closes spider valve 25, controller 59 provides a warning and will not close safety valve 61.

With spider slips 19 open, the operator lowers top drive 29, casing string 15 and new casing joint 45, which is now part of casing string 15. When the upper end of new casing joint 45 is a short distance above spider 17, the operator opens spider valve 25, which causes slips 19 to move downward back into a gripping position. The operator then repeats the cycle until the entire casing string 15 is run. When running casing string 15, the operator could rotate casing string 15 for drilling or reaming. Furthermore, drilling fluid would be pumped down through casing gripper 39 and casing string 15 if drilling is occurring. Spear 41 normally has a seal that seals to the inner diameter of casing string 15. As the casing string 15 lengthens, the weight being sensed by sensor 35 may be quite high when casing gripper 39 is supporting the entire weight of casing string 15. It is not necessary that an accurate weight be measured by sensor 35 once the amount is just over the minimum of the weight of casing gripper 39 plus one casing joint 45.

Figure 2:
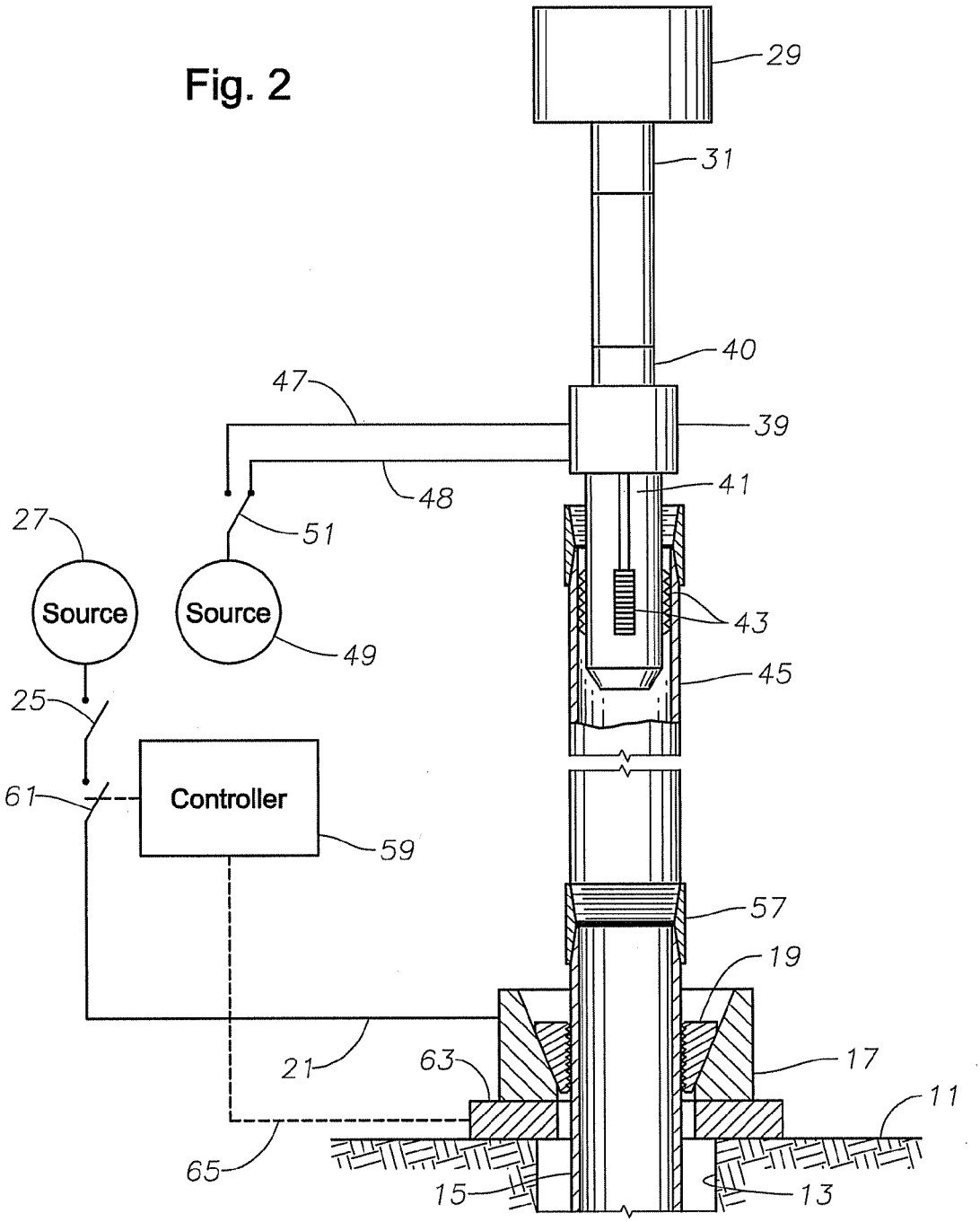
FIG. 2 is a schematic view of an alternative embodiment of this invention wherein a spider load sensor senses the weight supported by the spider.

FIG. 2 shows an alternate embodiment. The components that are the same use the same numerals as in FIG. 1. In this embodiment, casing gripper sensing sub 33 (FIG. 1) may be eliminated as illustrated. Alternately, it could be employed but used only to supply torque information to controller 59. In the embodiment of FIG. 2, a spider sensor unit 63 is employed for sensing the weight being supported by spider 17. Spider sensing unit 63 comprises a load cell that is a flat weight measuring scale with a central hole through it for the passage of casing string 15. Sensing unit 63 is capable of measuring a selected amount of weight. The selected amount of weight would at least be equal to the weight of spider 17, which may weigh hundreds of pounds. Controller 63 may have a panel and circuitry that will enable the operator to zero out the weight of spider 17 on spider sensor unit 63, so that it provides a signal indicating no weight if it is only sensing the weight of spider 17. Alternately, spider sensor unit 63 could be calibrated to send a signal only if the weight is greater than the weight of spider 17. When spider 17 is gripping a long string of casing 15 in a vertical well, a very large weight will be imposed on spider 17. However, spider sensor unit 63 need not be capable of measuring any accurate amounts of weight beyond much more than the weight of spider 17. There is no need for accuracy beyond a relatively low selected weight. Spider sensor unit 63 also will send a signal 65 to controller 59. The signal may be wireless or it may be via an electrical wire.

In the operation of the embodiment of FIG. 2, controller 59 will not allow hydraulic fluid pressure to move spider slips 19 to the released position unless the weight sensed by spider sensor unit 63 is no greater than the selected amount. FIG. 2 shows a position where new casing joint 45 has been made up to casing string 15. The operator must now raise top drive 29 a short distance to release the weight imposed on spider slips 19 by casing string 15. Until the operator lifts casing string 15 with top drive 29, the weight observed by spider sensor unit 63 will be over the selected amount because it will still be observing at least part of the weight of casing string 15. Consequently, controller 59 will not close safety valve 61. Closing spider valve 25 by the operator will have no effect unless the weight observed by spider sensor unit 63 is at or less than the selected amount.

Figure 3:
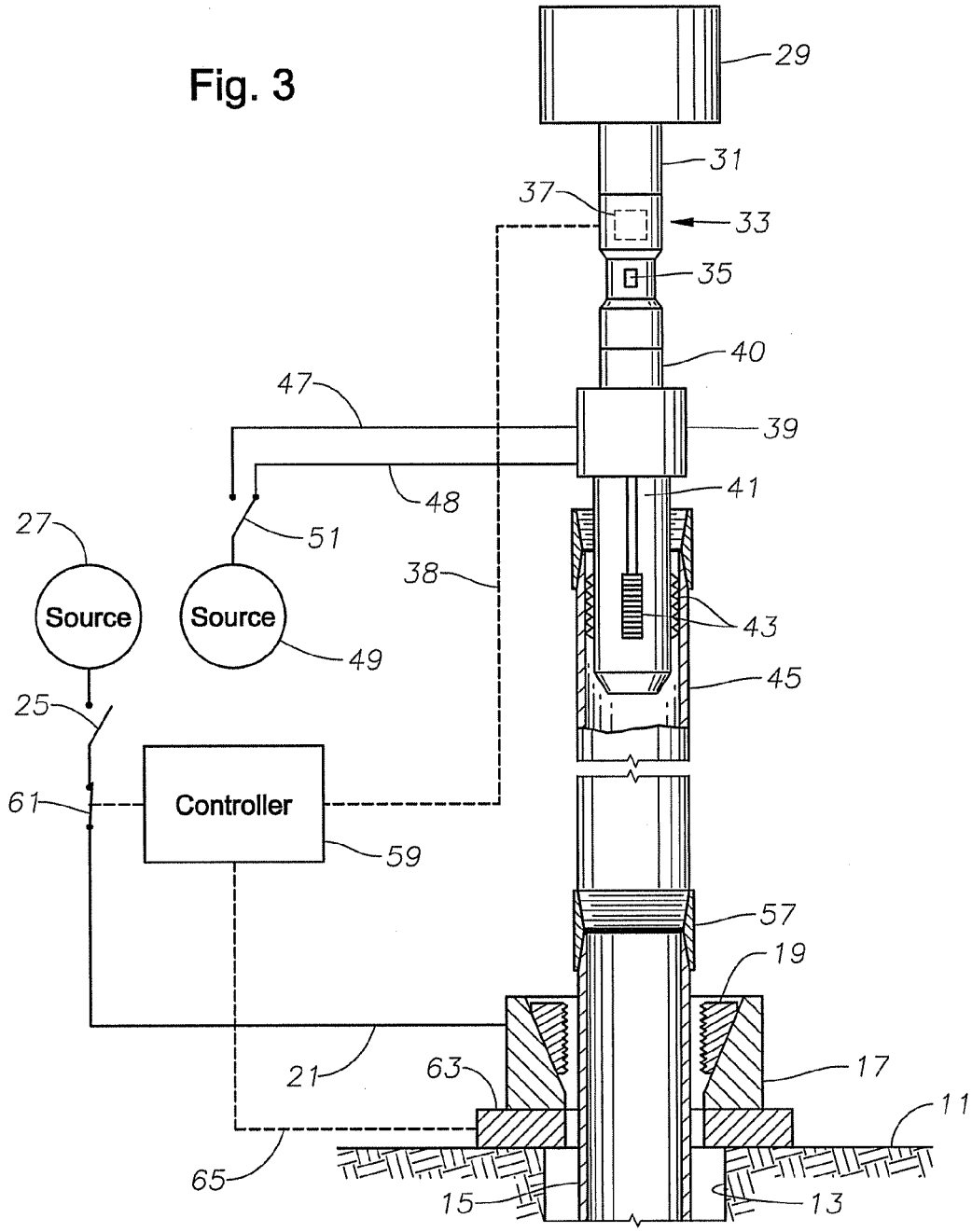
FIG. 3 is a schematic view of another embodiment of this invention, employing both the casing gripper sensor of FIG. 1 and the spider sensor of FIG. 2.

FIG. 3 illustrates both embodiments of FIGS. 1 and 2 coupled together as redundant safety systems. Controller 59 now must receive two satisfactory signals 38 and 65 before it will close safety valve 61. The signal that it must receive from spider sensor unit 63 is that there is no more than a selected weight being supported by spider 17 at that moment. The signal that it must receive from casing gripper sensing sub 33 is that the weight that it senses is greater than a selected minimum. When these two events occur, closing spider valve 25 will cause slips 19 to move up to the retracted position, which is the position shown in FIG. 3. The operator now is free to lower casing string 15 into the well.

Although the invention has been shown in only one of its forms, it should be apparent to those skilled in the art that it is not so limited but susceptible to various changes without departing from the scope of the invention. For example, although spider sensor unit 63 is shown as a separate unit mounted below spider 17, it could alternately include weight sensors mounted directed to and incorporated with spider 17. The spider sensing system of FIG. 2 could be employed with casing running operations that employ casing lifting mechanisms other than a casing gripper suspended from a top drive.

The invention claimed is:

1. A method of running casing into a well, comprising:

(a) suspending a casing string in the well with a spider located at the rig floor, and gripping and supporting a new joint of casing above the casing string with a casing lifting mechanism;

(b) with a snider load sensor, sensing a weight of the casing string being supported by the spider;

(c) rotating the new joint of casing to make up threads of the new joint of casing with the casing string so that the new joint of casing now becomes part of the casing string; then (d) with the casing lifting mechanism, lifting the casing string; then (e) releasing the spider and lowering the casing string until the upper end of the casing string is near the spider; then (f) gripping the casing string with the spider, then releasing the casing lifting mechanism and repeating steps (b)-(e); and (g) before releasing the spider in step (e), assuring that the casing lifting mechanism is gripping the casing string by requiring the weight being sensed by the spider load sensor be no greater than a selected amount.

2. The method according to claim 1, wherein the method further comprises providing the casing lifting mechanism with a casing lifting mechanism load sensor, and wherein step (g) comprises:

sending from the casing lifting mechanism load sensor a signal indicative of the weight being supported by the casing lift mechanism, determining whether the weight sensed by the casing lifting mechanism is greater than a minimum amount, and allowing the release of the spider only if so.

3. The method according to claim 1, wherein the method further comprises mourning a mechanism load sensor between the casing lifting mechanism and a top drive, and wherein step (g) comprises:

sending from the casing lifting mechanism load sensor a signal indicative of the weight being supported by the casing lifting mechanism and determining whether the weight sensed by the casing lifting mechanism load sensor is greater than a weight of the casing lifting mechanism by a selected amount, and releasing the spider only if so.

4. The method according to claim 1, wherein the method further comprises mounting a casing lifting mechanism load sensor between the casing lifting mechanism and a top drive, and wherein step (g) comprises:

sending from the casing lifting mechanism load sensor a signal indicative of the weight being supported by the casing lifting mechanism and determining whether the weight sensed by the casing lifting mechanism load sensor is greater than a weight of the casing lifting mechanism plus an approximate weight of a selected number of joints of casing, and allowing the release of the spider only if so.

5. The method according to claim 1, wherein the spider load sensor is mounted so as to sense a weight of the spider, and wherein step (g) comprises:

wherein the selected amount comprises the weight of the spider.

6. The method according to claim 1, further comprising placing the spider load sensor between the spider and a portion of the rig, and wherein step (g) comprises:

sending to a controller from the spider load sensor an electrical signal indicative of weight imposed on the spider and with the controller determining whether the weight sensed by the spider sensor is greater than a weight of the spider, and if so, preventing the release of the spider.

7. A method of running casing into a well with a rig having a casing gripper depending from a top drive, comprising:

(a) providing the casing gripper with a casing gripper load sensor and a spider with a spider load sensor;

(c) suspending a casing string in the well with the spider;

(c) gripping a new joint of casing with the casing gripper, rotating the casing gripper and the new joint of casing to make up threads of the new joint of casing with the casing string so that the new joint of casing now becomes part of the casing string; then (d) raising the top drive and the casing gripper;

(e) sending a signal from the easing gripper load sensor to a controller indicative of weight being supported by the casing gripper, and sending a signal from the spider load sensor to the controller indicative of weight being supported by the spider;

(f) determining with the controller whether the weight sensed by the casing gripper load sensor indicates at least a selected minimum amount of weight is being supported by the easing gripper, and determining with the controller whether the weight sensed by the spider load sensor indicates no more than a selected minimum amount of weight is being supported by the spider; and (g) if both determinations in step (f) are in the affirmative, allowing the spider to be released, and if either determination in step (f) is in the negative, preventing the release of the spider.

8. The method according to claim 7, wherein, step (a) comprises mounting spider load sensor below the spider as to sense a weight of the spider, and wherein step (f) comprises:

determining whether the weight sensed by the spider load sensor is greater than a weight of the spider.

9. The method according to claim 7, wherein step (a) comprises mounting the casing gripper load sensor between the top drive and the casing gripper, and wherein step (f) comprises:

determining whether the weight sensed by the casing gripper load sensor is greater than a weight of the casing gripper plus an approximate weight of a selected number of casing joints.

10. A method of running casing into a well having a casing lifting mechanism and a spider at a rig floor, comprising:

(a) providing the spider with a spider load sensor;

(b) suspending the casing string in the well with the spider;

(c) gripping a new joint of casing with the casing lifting mechanism, rotating the new joint of casing to make up threads of the new joint of casing with the casing string so that the new joint of casing now becomes part of the casing string; then (d) lifting the casing lifting mechanism before releasing the spider;

(e) with the spider load sensor, sensing weight supported by the spider after the casing lifting mechanism has been lifted and sending an electrical signal from the spider load sensor to a controller indicative of the weight being sensed by the spider load sensor;

(f) determining with the controller whether the weight sensed indicates more than a selected minimum amount of weight is being supported by the spider; and (g) if step (f) is in the negative, allowing the spider to be released, and if step (f) is in the affirmative, preventing the release of the spider.

11. The method according to claim 10, wherein step (a) comprises placing the spider load sensor between the spider and a portion of the rig such that the spider load sensor senses a weight of the spider, and wherein step (f) comprises:

determining whether the weight sensed is greater than a weight of the spider, and if so, preventing the release of the spider.

* * * * *